United States Patent [19]

Birkhofer et al.

[11] Patent Number: 4,733,811

[45] Date of Patent: Mar. 29, 1988

[54] MACHINE FOR ATTACHING BUTTONS, RIVETS, OR SIMILAR TO GARMENTS

[75] Inventors: Herbert Birkhofer; Hans-Otto Höffler, both of Braunschweig, Fed. Rep. of Germany

[73] Assignee: Schaeffer Scovill Verbindungstechnik GmbH, Fed. Rep. of Germany

[21] Appl. No.: 883,068

[22] Filed: Jul. 8, 1986

[51] Int. Cl.[4] ..... B25C 5/00; B27F 7/00

[52] U.S. Cl. ..... 227/105; 227/118; 112/113

[58] Field of Search ..... 112/113, 104, 110, 111, 112/112; 227/118, 105, 117, 104

[56] References Cited

U.S. PATENT DOCUMENTS

| | | | |
|---|---|---|---|
| 2,007,274 | 7/1935 | Johnson | 227/118 |
| 2,207,742 | 7/1940 | La Chapelle | 227/105 X |
| 2,878,954 | 3/1959 | Troske | 227/118 |
| 3,329,112 | 7/1967 | Mitchell et al. | 112/113 |
| 3,363,805 | 1/1968 | Prezes | 112/113 X |
| 3,483,833 | 12/1969 | Connor, Jr. | 112/113 |
| 3,565,285 | 2/1971 | Asnes | 112/113 X |
| 4,463,889 | 8/1984 | Sartran | 227/117 X |

FOREIGN PATENT DOCUMENTS 2826418 12/1979 Fed. Rep. of Germany .

*Primary Examiner*—H. Hampton Hunter
*Attorney, Agent, or Firm*—Wood, Herron & Evans

[57] ABSTRACT

A machine is disclosed for feeding button parts from a magazine to an attachment position. The machine includes an arcuate sliding surface which guides the button parts to the attachment position, and a transport finger which moves along the sliding surface. The transport finger is spring-urged outwardly to move the button parts in one direction, but is shiftable inwardly to pass over button parts when moved in the opposite direction.

7 Claims, 12 Drawing Figures

MACHINE FOR ATTACHING BUTTONS, RIVETS, OR SIMILAR TO GARMENTS

BACKGROUND OF THE INVENTION

The invention concerns machines for attaching buttons, rivets or similar to garments and is particularly directed to machines of the type in which the button parts are fed from a magazine side, on up to near the position of attachment, and are transferred from there into attachment position. Such machines include a guide channel which feeds the button parts in an upright position and which discharge them at approximately a 90° angular offset relative to the position of attachment. The machine further includes a sliding surface extending between the point of discharge and the attachment position. This sliding surface has the shape of a circular arc, extending tangentially from the area of discharge from the guide channel to the position of attachment. The arc is also approximately tangential to this position. A transport finger rotating in oscillating fashion cooperates with the sliding surface to transfer one button part at a time into attachment position.

A prior art machine of this general type is known from the German patent disclosure No. 2,826,418, where a transport finger is fashioned as a rotatable ring section featuring on its insertion end a receiving pocket. This solution makes it necessary for the ring section to release the insertion area only briefly when the punch of the upper tool is at lower dead center.

SUMMARY OF INVENTION

The problem underlying the invention is to so design a machine of the general type described in which that the point of discharge will be released for a longer period of time.

The present invention is predicated in part upon the concept of providing a transport finger which is designed as a thrust component. The transport finger is spring urged outwardly. In its advancing direction of movement, it engages the button part and moves it along its rotary path from the point of discharge from the guide channel to the attachment position. During its reverse movement along the circular arc, the transport finger moves inwardly against a spring force so that it skips across a button part at the discharge point. This button part is thereafter engaged by the finger as it moves in the feeding direction and is shifted along the arcuate path.

One advantage of the present machine is that it facilitates a high rate of attachment. This means that the economy of such a machine is increased. In the present device, while the transport finger passes one button part onto the tool, the next button part can be moved to the point of discharge. The transport finger passes in its reaction the button part which is located at the point of discharge, skips across it and proceeds in a rear position relative to it, due to a springed yield motion. This can be accomplished for both a lower and an upper insertion device, i.e., mechanisms for inserting both the upper and lower halves of a button. The transport finger drive can be effected by a mechanical linkage to the upper tool ram motion. The drive for the insertion devices is preferably spring-actuated in the feed, or insertion, direction and positive in the retraction direction. The transport fingers are positively retracted mechanically as the upper tool ram moves down. This prevents the danger of collision. As the upper tool ram moves upward, the transport fingers are actuated by springs. In case of binding button parts caused by form or dimensional variations, or foreign matter, the transport finger will stall without any danger of damage. This design also permits a manual insertion.

In the preferred embodiment, the transport finger of the lower insertion drive is mounted on a shaft driven in an oscillating manner. The transport finger coordinated with the upper tool, on the other hand, is mounted on a double arm lever which, in turn, is controlled directly by the downward motion of the upper tool. The pass-through slot in the sliding surface, for the transport finger located inside the sliding guide ring, provides guidance for the transport fingers. Retraction movement of the transfer finger past the button is facilitated because the arm needs to pass only the base surface of the button part and no other protrusions. Therefore, malfunctions do not occur in the transfer of the button part. The transport finger situated inside the sliding guide ring, additionally, makes a specific finger protection unnecessary.

Depending on the button part design, a guide channel with an appropriate chute is to be used. An exchange of the guide channel can be carried out in short order. In order for the button part to remain in the area of discharge from the guide chute, in the upper tool a button part retarding spring is coordinated with the latter. As the case may be, an appropriate retarding spring may be coordinated also with the exit end of the guide channel. The respective control of the transport finger coordinated with the upper tool is effected by way of the downward pointing upper tool ram having a beveled control surface. By this means, the actuation of the double arm finger lever is made rather gentle.

A preferred embodiment of the invention will be described hereafter with the aid of FIGS. 1 through 12.

DETAILED DESCRIPTION OF A PREFERRED EMBODIMENT

Figure 1:
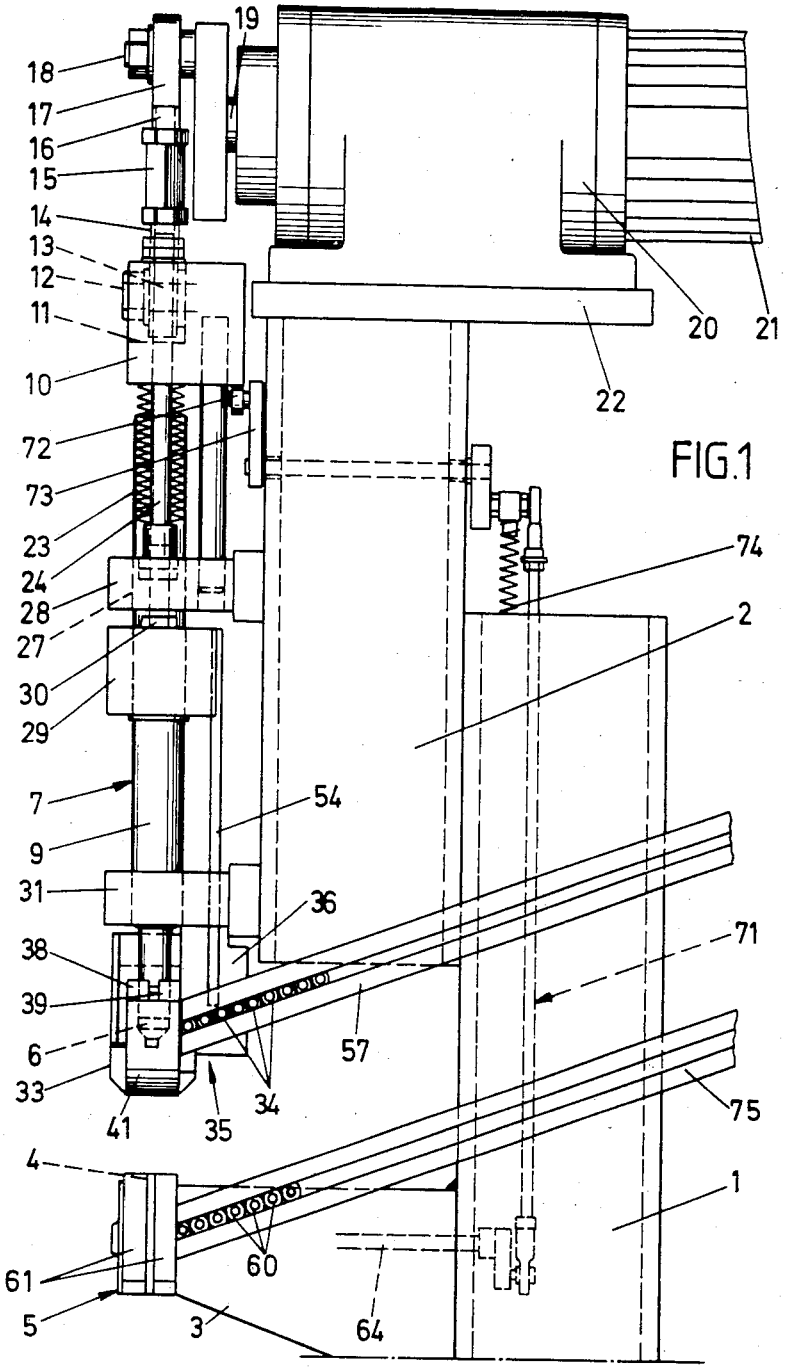
FIG. 1 shows a side view of the machine with the column omitted and the upper tool ram in the upper dead center position.
Figure 2:
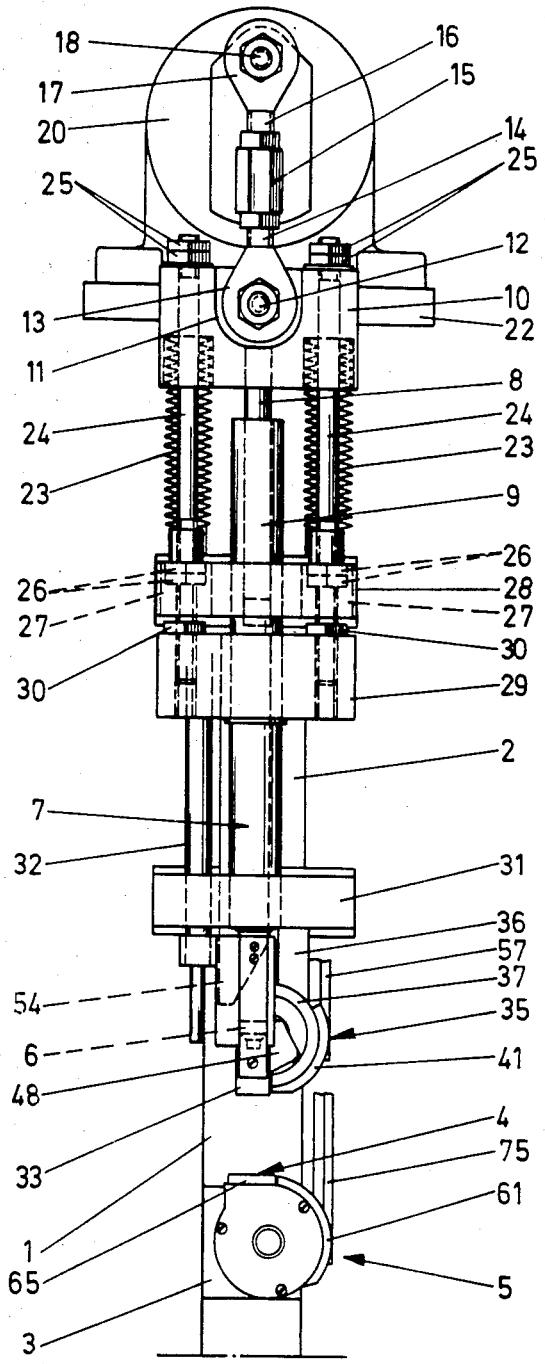
FIG. 2 is a front elevation of the machine.

The machine comprises a column 1 supported by a base, not shown. Extending from its top end is a column head 2 underneath which the column 1 supports a cantilever arm which extends in the same direction and serves to receive the lower tool 4. The cantilever arm 3 also accommodates on its free end the lower inserting device 5 for the lower tool 4.

An upper tool 6 is aligned with the lower tool 4, and extends above it. Upper tool 6 is attached on its front end to a split upper tool ram 7 which is composed of a part 8 with a reduced cross section and a part 9 with a larger cross section. The upper part 8 originates from a horizontal force application plate 10 and forms the inside mandrel of the second part 9. The force application plate 10 is provided on its front side with an upwardly open recess 11. The bearing journal 12 of the plate 10 extending into it passes through an eye 13 which extends into a threaded pin 14. The latter engages the internal threading of a crank web 15 and is prevented from turning by a nut. Screwed into the opposite end of the crank arm 15 is another threaded pin 16 which on its end also features an eye 17. Extending through the latter is a journal 18 of a driving crankshaft 19 which, in turn, originates from a braking drive 20. An electromotor 21 flanged to the braking drive 20 serves to rotate the crankshaft 19. The brake drive is mounted on a horizontal face plate 22 of the column head 2.

The force application plate 10 transmits the motion of the crank arm 15 to the lower part 9 of the upper tool ram 7 via two spring assemblies 23 consisting of bevel springs. The spring assemblies are contained on two adjustment screws 24 which are arranged symmetrically relative to the upper tool ram 7, extend through the bores of the force application plate 10 and feature on their free upper end protruding beyond the force assemblies plate 10 two jam nuts 25. One bearing point for the spring assemblies 23 is the force application plate 10 itself, whereas the other bearing point is formed by two jam nuts 26 which are arranged on the adjustment screws 24. These nuts and the bottom ends of the adjustment screws 24 facing them pass through bores 27 of a horizontal bearing plate 28 originating from the column head 2. The ends of the adjustment screws 24 which protrude beyond the bearing plate 28 are screwed into a ram yoke 29 and are rotationally fixed by means of nuts 30. This spring arrangement makes it possible to change the spacing of the upper tool 6 relative to the lower tool 4 while at the same time changing the spring pressure. Furthermore, the adjustment screw shanks can be so turned that only a height change of the ram yoke 29, and thus of the upper tool ram 7, will occur. A rough spacing adjustment can then be made in that the threaded pin 14 is screwed further into or out of the crank arm 15. This will not change the spring pressure of the spring packages 23 either.

Extending underneath the bearing plate 28 at a parallel spacing is another bearing plate 31 which is fixed near the bottom end of the column head 2.

In a manner not illustrated in detail, a downward guide rod 32 originates from the force application plate 10. It features on its bottom end tongs 33 which spread apart against spring action. As the guide rod 32 is released from its braking position toward the force application plate 10, it can move in downward direction a specific distance, along with the tongs attached to it. But the downward movement takes place only after loading the tongs 33 with a button top part 34. The button top parts 34 are fed to the tongs 33 by an upper inserting device 35. An integral part of the upper insertion device is a small pillow block 36 which is fixed on the lower bearing plate. The pillow block 36 supports on its front a split sliding guide ring 37 which is composed of the two half shell rings 38 and 39 which are arranged paralled to one another leaving a pass-through slot 40 between themselves. The bottom end of the individual rings 38, 39 extends up to the tongs 33. A button part guide channel 41 of circular arc shape nests over the outside sliding surface which the retaining rings 38, 39 form for the button top parts 34.

Figure 3:
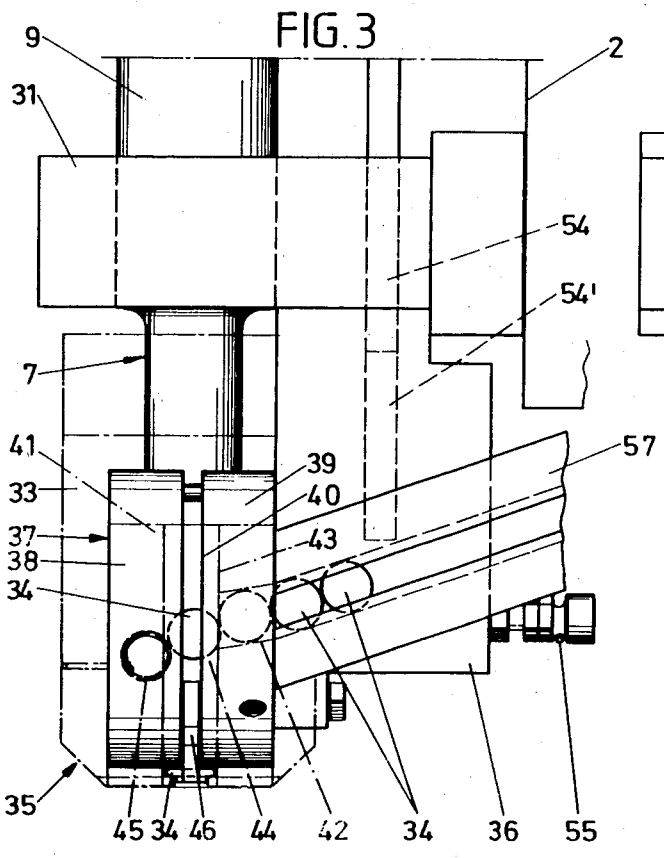
FIG. 3, in approximately actual size, is a front view of the upper insertion device coordinated with the upper tool ram with the button part guide channel and tongs indicated by dash-dot lines.
Figure 6:
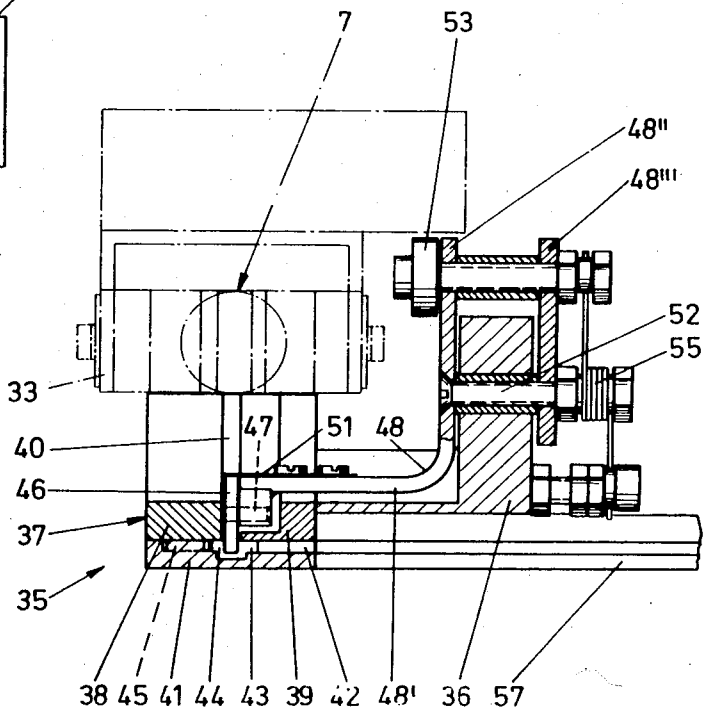
FIG. 6 is a horizontal section at the level of the axle of the double arm lever of the upper insertion device.

The button top parts 34 proceed to the sliding surface by way of an internal transverse opening 42 of the guide channel 41. The transverse opening 42 is slightly inclined toward an inside guide channel 43 for the button top parts 34, which guide channel 43 is situated opposite the pass-through slot 40. The guide channel accommodates closely below the discharge point 44 a button part retarding spring 45 so that the button top part 34 located at the discharge point 44 will retain its position according to FIG. 3. The diameter of the button top part 34 is larger than the pass-through opening of the guide channel 43 in the area of the retarding spring 45.

A transport finger 46 serves to insert the button top part 34 in the tongs 33. The transport finger pivots on a pin 47 of a double arm lever 48 and is provided with a longitudinal slot 49 which is engaged by a driver 50 of the lever 48. A leaf spring 51 loads the transport finger 46 counterclockwise so that its entraining end 46′ tends to engage the guide channel 43. In so doing, the transport finger 46 sits on the one angled arm 48′ of the double lever 48. The latter is mounted on a axle 52 of the small pillow block 36 which is horizontally aligned and arranged offset to the axis of the upper tool ram 7. The other lever arm 48″ features on its end a roll 53 which is adopted to engage a vertical slide 54. The latter is fitted on its bottom end with a control bevel 54′. The slide 54 originates from the ram yoke 29 where it is fixed.

Figure 4:
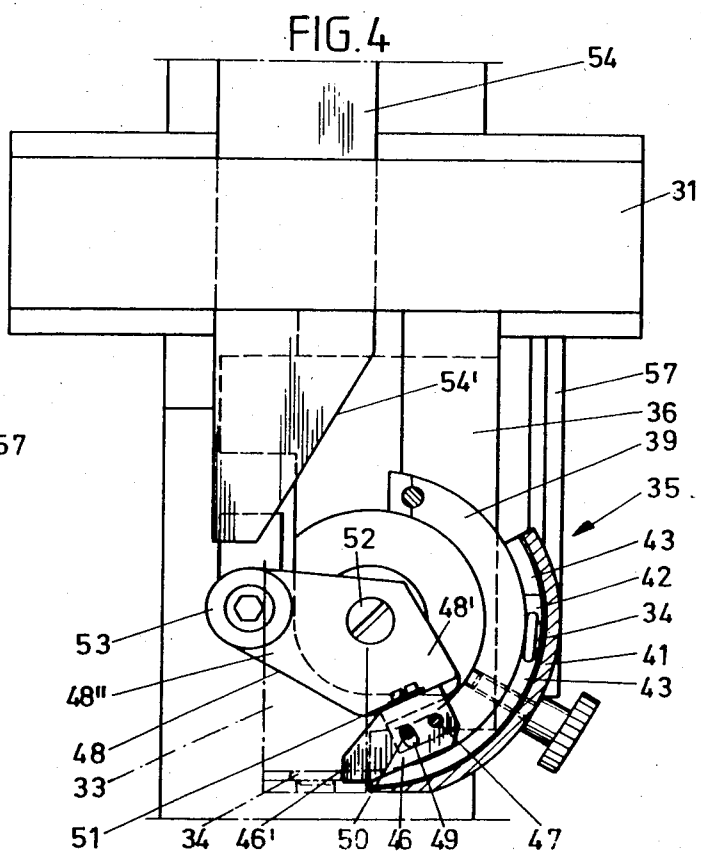
FIG. 4 is a side view of the insertion device illustrated in FIG. 3, partly in section, with the upper tool ram omitted and the transport finger in the inserting position adjacent to the tongs indicated by dash-dot lines.
Figure 5:
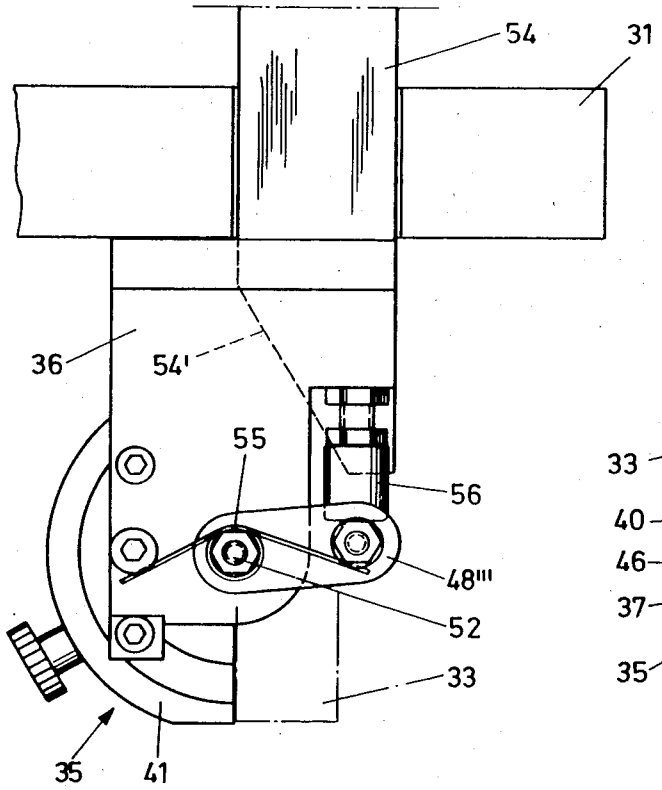
FIG. 5 is a rear view of FIG. 3 depicting the spring loading of the insertion device illustrated in the transport finger.

A torsion spring 55 arranged on the axle 52 stresses the double arm lever 48 in return direction, in such a way that the lever tends to assume with its transport finger 46 the position according to FIG. 4 for transferring a button top part 34 to the tongs 33. This position is limited by a stop 56 which is fastened to the pillow block 36 and which the lever arm 48 encounters in a second position 48‴; compare specifically FIG. 5.

The button top parts 34 proceed from a not illustrated magazine by way of an upright and inclined guide channel 57 to the transverse opening 42 of the button part guide channel 41.

The lower inserting device 5 possesses also a sliding guide ring 58 forming a pass-through slot 58 and, with its cylinder surface adjacent to the pass-through slot 59, the sliding surface for the button bottom parts 60. A button part guide channel 61 nests over the sliding surface. It is provided as well with an inclined inside transverse opening 62 which communicates with the guide channel 63. The latter is adapted to the cross sectional shape of the button bottom part 60 and so designed that the button bottom part 60 will bear on the sliding surface with its larger base surface 60′. Originating from the base surface 60′ and evenly distributed on the circumference, the serrations 60″ point outward and extend into the guide channel 63.

A shaft 64 extends through the center of the sliding guide ring, the axis of said shaft being offset relative to the vertical axis of the lower tool 4. Coordinated with the lower tool is a springed frame 65 indicated by dash-dot lines. The shaft 64 supports on its free end a clamped support 66 for a transport finger 67 which pivots on a pin 68 of the support 66. A leaf spring 69 stresses the transport finger 67 with its driver end 60′ outwardly in such a way that this end 67′ tends to engage the guide channel 63. The motion of the transport finger 67 is limited by a stop pin 70 of the support 66.

The shaft itself is driven in oscillating fashion, for which purpose it is coupled with a linkage 71. The other end of the linkage 71 lies with a roll 72 of a lever 73 in the path of the force application plate 10. This means that the shaft 64 is positively shifted as the upper tool ram performs a downstroke. A spring 74 is coordinated with the linkage 71 and, in the upward stroke of the upper tool ram 7, moves the shaft 64 with the support 66 and the transport finger 67 in insertion position.

The transverse opening 62 communicates with an upright guide channel 75 by way of which the lower tool 4 is supplied with button parts 60 from a magazine (not shown).

Figure 7:
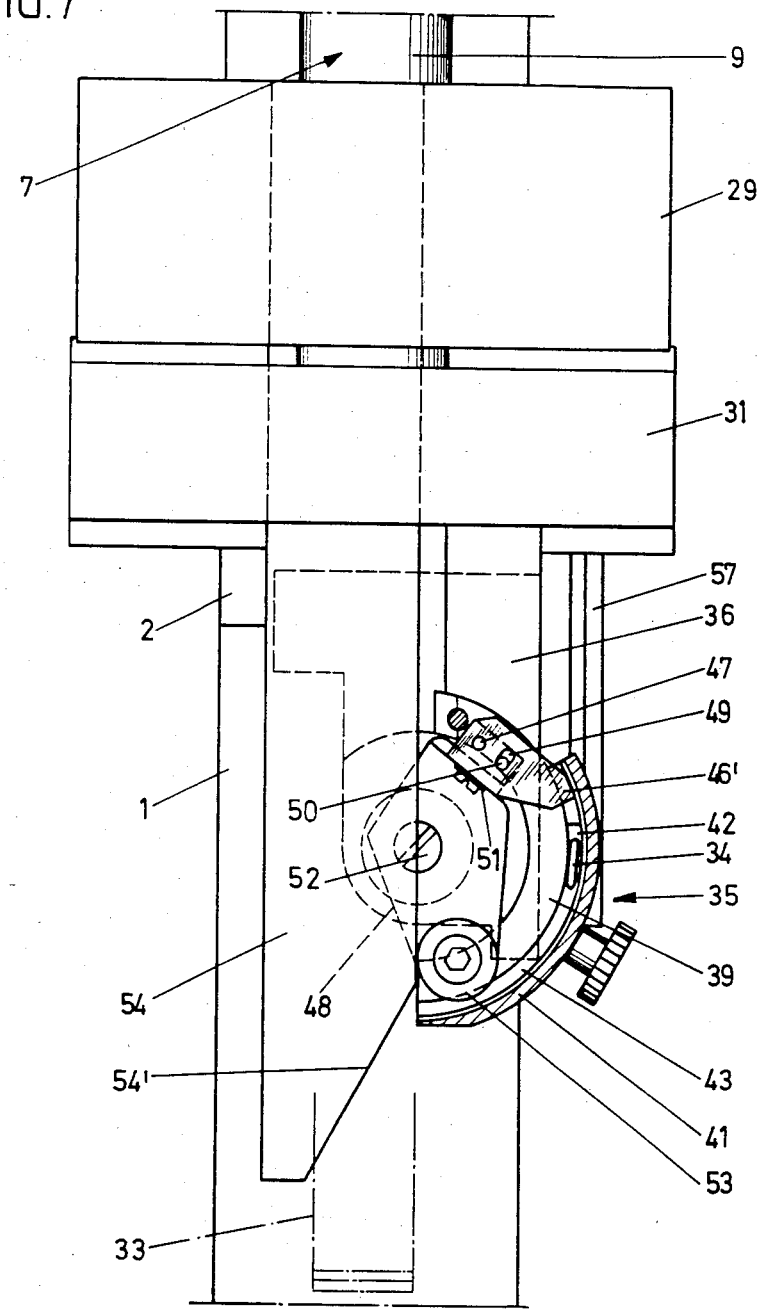
FIG. 7 is a view corresponding to FIG. 4, with the upper tool ram advanced down to the lower dead center and the transport finger retracted.
Figure 9:
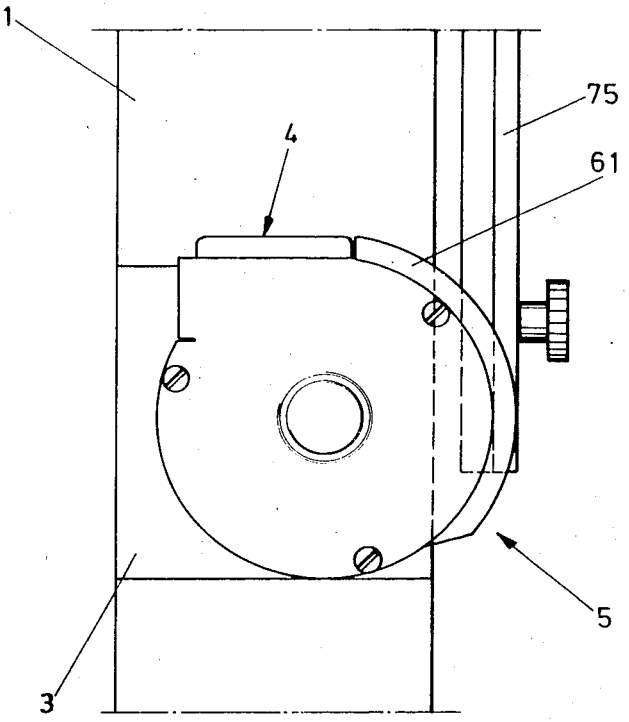
FIG. 9 is a side view of the insertion device shown in FIG. 8.
Figure 8:
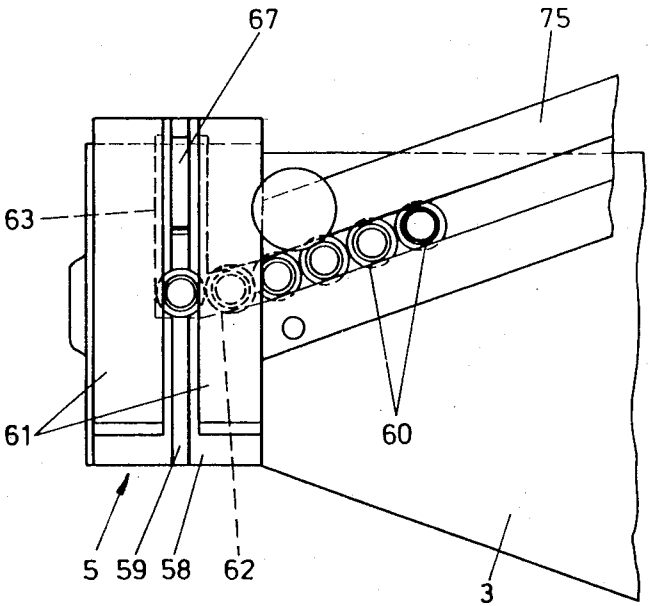
FIG. 8 is a front view of the lower insertion device in approximately actual size.
Figure 12:
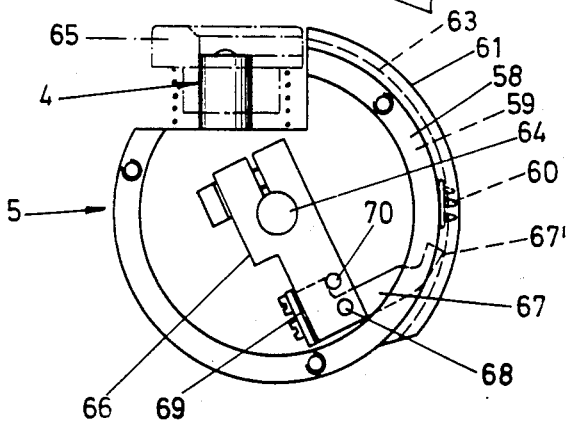
FIG. 12 is a view corresponding to FIG. 10, with the transport finger in retracted position.

The operating mode is as follows: Once the lower tool 4 and the tongs 33 are properly loaded with button parts 34, 60, the riveting operation can be initiated by switch actuation. First, the guide rod 32 with the tongs 33 attached is released for downward motion in such a way that the tongs 33 will come to a standstill closely above the lower tool 4. Only then will the drive of the upper tool ram 7 set in. Its upper tool 6 spreads the jaws of the tongs 33 apart. Next, the button top part 34 has already been gripped by the upper tool 6 and can be joined with the button bottom part 60. The joining force acting on the rivet components 34, 60 is adjustable as needed. The slide 54 is entrained in this downward shift, actuating by way of its control bevel 54′ the roll 53 of the lever 48 and moving it in the position according to FIG. 7. In this process, the transport finger 46 overruns the button top part 34 which is located at the discharge point. This overrunning is possible in that the transport finger 46 yields elastically. Assumed is then the position according to FIG. 7, in which the transport finger 46 extends with its driver end 46′ into the guide channel 43. Simultaneous with the downward shift of the upper tool ram, the shaft 64 was turned through the linkage 71, moving in turn the support 66 with the transport finger 67 in the position according to FIG. 12. The transport finger 67 was able to underrun the button bottom part 60 located at the point of discharge and to yield elastically. Thereafter, the stop-limited position of the transport finger 67 is in effect again, in which the driver end 67′ protudes into the guide channel 63.

As the upper tool ram with the entrained tongs 33 moves in its upper dead center position, the ram 54 lifts off the roll 53. The torsion spring 55 advances then the transport finger 46 into insertion position, in the course of which the finger entrains with its driver end 46′ the respective button top part 34, pushing it into the tongs 33. Effective again is now the initial position according to FIGS. 3 and 4.

Figure 10:
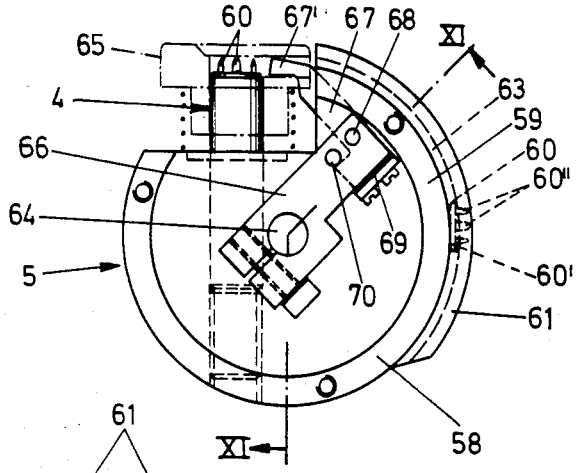
FIG. 10 is a front view of the lower insertion device with the cover removed and the transport finger in inserting position.
Figure 11:
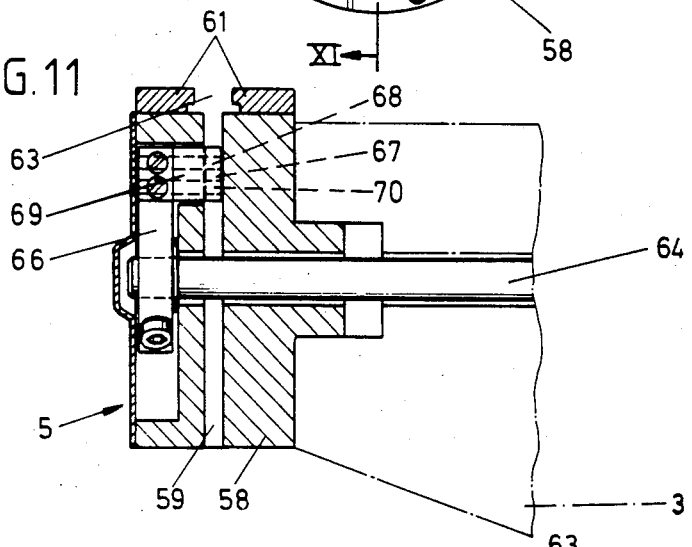
FIG. 11 is a section along line XI—XI of FIG. 10.

During the upward motion of the upper tool ram, the spring 74 also repositions the shaft 64 with the support 66 and transport finger 67 in the position according to FIG. 10 while entraining the respective button bottom part 60. A new riveting operation can now begin.

From the foregoing disclosure of the general principles of the present invention and the above disclosure of a preferred embodiment, those skilled in the art will comprehend various modifications to which the invention is susceptible. Therefore, we desire to be limited only by the scope of the following claims. In the claims it is to be understood that "fastener" is used in a generic sense to refer to buttons, rivets or the like.

Having described our invention, we claim:

1. A machine for attaching fastener parts to garments, said machine being adapted to receive said fastener parts in an upright position from the discharge exit of a guide channel supplied by a magazine and to transfer said fastener parts to a horizontal attachment position, said machine comprising:

fastener part engaging means including a sliding surface extending from said discharge exit to said attachment position, said sliding surface being configurated to form a segment of a circle, said sliding surface being tangential to said discharge exit and to said attachment position;

a guide rail concentric with said sliding surface and spaced outwardly thereof;

a transport finger shiftable along said sliding surface toward and away from said attachment position;

means supporting and driving said transport finger;

spring means urging said transport finger outwardly toward said guide rail, whereby said transport finger is effective to shift a fastener part toward said attachment position when said transport finger is moved in one direction and is effective to move past a stationary fastener when the finger is moved in the opposite direction.

2. The machine of claim 1 further comprising a shaft, said transport finger being carried by said shaft, said shaft being disposed concentric with the arc of said sliding surface and being oscillated.

3. The machine of claim 1 further comprising an upper tool and a lower tool, means coordinating movement of said transport finger with the upper tool, said transport finger being spring-loaded in the direction of retraction, and being mounted on a double arm lever, said lever having an end opposing the finger, and means controlling movement of said end by the downward motion of said upper tool.

4. The machine of claim 1 in which said sliding surface has a pass-through slot for receiving the transport finger, and in which said transport finger is disposed at an angle to a tangent of said sliding surface toward the said guide rail.

5. The machine of claim 1 in which a braking spring is mounted on said guide rail adjacent to said discharge point of said guide channel.

6. The machine of claim 3 further comprising a ram, a yoke carried by said ram, a slide carried by said yoke and extending downwardly therefrom, a control bevel on the lower end of said slide, a roll on one arm of the double arm finger lever disposed for engagement with said control bevel.

7. The machine of claim 1 further including a vertically shiftable upper tool, means coordinating the movement of the transport finger with said upper tool, spring means loading said transport finger in the direction of retraction away from said attachment position, said finger being mounted upon a double arm lever, means shiftable with said upper tool and disposed for engagement with the end of said double arm lever remote from said finger, whereby said double arm lever is shifted upon downward movement of said tool.

* * * * *